US011628106B1

(12) United States Patent
Chitalu et al.

(10) Patent No.: US 11,628,106 B1
(45) Date of Patent: Apr. 18, 2023

(54) WHEELCHAIR WITH INTEGRAL MASSAGING UNITS

(71) Applicants: Rosiella L. Chitalu, Irving, TX (US); Logan Dillinger, Pittsburg, KS (US)

(72) Inventors: Rosiella L. Chitalu, Irving, TX (US); Logan Dillinger, Pittsburg, KS (US)

( * ) Notice: Subject to any disclaimer, the term of this patent is extended or adjusted under 35 U.S.C. 154(b) by 1151 days.

(21) Appl. No.: 16/104,777

(22) Filed: Aug. 17, 2018

Related U.S. Application Data

(63) Continuation-in-part of application No. 15/006,271, filed on Jan. 26, 2016, now abandoned.

(60) Provisional application No. 62/131,366, filed on Mar. 11, 2015.

(51) Int. Cl.
*A61H 7/00* (2006.01)
*A61G 5/10* (2006.01)
*A61G 5/12* (2006.01)

(52) U.S. Cl.
CPC ..... *A61G 5/1048* (2016.11); *A61G 5/121* (2016.11); *A61H 7/007* (2013.01); *A61G 5/1091* (2016.11); *A61H 2201/0149* (2013.01)

(58) Field of Classification Search
CPC .. A61H 2007/009; A61H 7/002; A61H 7/004; A61H 7/007; A61H 7/00; A61G 5/127; A47C 7/50; A47C 7/503; A47C 7/5064
See application file for complete search history.

(56) References Cited

U.S. PATENT DOCUMENTS 1,165,489 A * 12/1915 Berry ..... A47C 1/035 297/359
3,223,450 A * 12/1965 Pollock ..... A47C 31/023 5/403
4,686,967 A * 8/1987 Hashimoto ..... A61H 1/00 601/116
5,137,016 A * 8/1992 Yamasaki ..... A61H 15/0078 601/102
5,233,973 A * 8/1993 Gill ..... A61H 1/00 601/103
5,713,591 A * 2/1998 Zarkhin ..... A61G 5/127 280/291
5,769,799 A * 6/1998 Daughtry ..... A61H 15/0078 601/115
6,015,394 A * 1/2000 Young ..... A61G 5/127 601/55
6,120,468 A * 9/2000 Tseng ..... A61H 23/0254 601/46
7,128,721 B2 * 10/2006 Ferber ..... A61H 7/004 601/86
8,628,104 B1 * 1/2014 Stare ..... A61G 5/1054 280/304.1

(Continued)

FOREIGN PATENT DOCUMENTS

DE 4406542 * 2/1994 ..... A47C 3/029

*Primary Examiner* — Michael J Tsai
(74) *Attorney, Agent, or Firm* — Kenneth L Tolar

(57) ABSTRACT

A wheelchair includes massaging units integral with both the seat and the backrest. A first massaging unit includes a plurality of vibrating members positioned about the periphery of the backrest that can be activated simultaneously, sequentially, individually or in a random pattern to knead the user's back, shoulders and neck. A second massaging unit includes motorized massaging discs that rotate and linearly reciprocate to provide a unique "rolling" massage to the buttocks and thighs.

14 Claims, 4 Drawing Sheets

(56) References Cited

U.S. PATENT DOCUMENTS

| | | | | |
|---|---|---|---|---|
| 2002/0138023 | A1* | 9/2002 | Kume | A61H 7/007 601/99 |
| 2004/0049136 | A1* | 3/2004 | Lin | A61H 23/0254 601/86 |
| 2006/0085919 | A1* | 4/2006 | Kramer | A47C 27/083 5/713 |
| 2008/0077061 | A1* | 3/2008 | Dehli | A61H 39/06 601/118 |
| 2009/0270778 | A1* | 10/2009 | Wu | A61H 7/007 601/97 |
| 2009/0306559 | A1* | 12/2009 | Tsai | A61H 7/007 601/128 |
| 2010/0038880 | A1* | 2/2010 | Bagg | A61G 5/1078 16/18 R |
| 2010/0137762 | A1* | 6/2010 | Tsai | A61H 7/002 601/134 |
| 2011/0087139 | A1* | 4/2011 | Ferber | A61H 7/007 601/134 |
| 2012/0215143 | A1* | 8/2012 | Inada | A61H 9/0078 601/112 |
| 2012/0226207 | A1* | 9/2012 | Lev | A61H 7/004 601/149 |
| 2013/0160786 | A1* | 6/2013 | Fujioka | A45D 19/14 132/200 |
| 2013/0264800 | A1* | 10/2013 | Kobayashi | A61G 5/006 280/650 |
| 2015/0051526 | A1* | 2/2015 | Wang | A61H 15/0078 601/99 |
| 2015/0157528 | A1* | 6/2015 | Le | A61H 23/006 601/99 |
| 2016/0151234 | A1* | 6/2016 | Chen | A61H 15/0078 601/113 |
| 2018/0221242 | A1* | 8/2018 | Lee | A61H 39/06 |

* cited by examiner

WHEELCHAIR WITH INTEGRAL MASSAGING UNITS

CROSS REFERENCE TO RELATED APPLICATIONS

This application is a continuation-in-part of application Ser. No. 15/006,271 filed on Jan. 26, 2016, which claimed the benefit of provisional patent application No. 62/131,366 filed on Mar. 11, 2015, the specifications of which are both incorporated herein by reference.

BACKGROUND OF THE INVENTION

The present invention relates to a wheelchair having integral massaging units for preventing pressure sores and muscle aches.

DESCRIPTION OF THE PRIOR ART

Those who are confined to a wheelchair often suffer from pressure sores due to prolonged, static contact with the wheelchair surfaces. Furthermore, the sedentary lifestyle of wheelchair confinement usually causes muscle or joint pain. Therefore, those who use a wheelchair must receive constant physical therapy or otherwise endure the above-described afflictions.

Accordingly, there is currently a need for a wheelchair that does not cause pressure sores or muscular aches. The present invention addresses this need by providing a wheelchair having massaging units integral with the backrest and the seat for preventing pressure sores and alleviating muscle aches.

SUMMARY OF THE INVENTION

The present invention relates to a wheelchair comprising massaging units integral with the seat and the backrest. The backrest massaging unit includes a plurality of vibrating members positioned about the periphery of the backrest that can be activated simultaneously, sequentially, individually or in a random pattern to knead the user's back, shoulders and neck. The seat massaging unit includes motorized massaging discs that both rotate and linearly reciprocate to provide a unique "rolling" massage to the buttocks and thighs.

It is therefore an object of the present invention to provide a wheelchair having integral massaging units for preventing pressure sores and alleviating muscle aches.

It is therefore another object of the present invention to provide a wheelchair having a unique massaging unit integral with the seat that rotates and linearly reciprocates to provide a unique therapeutic experience.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
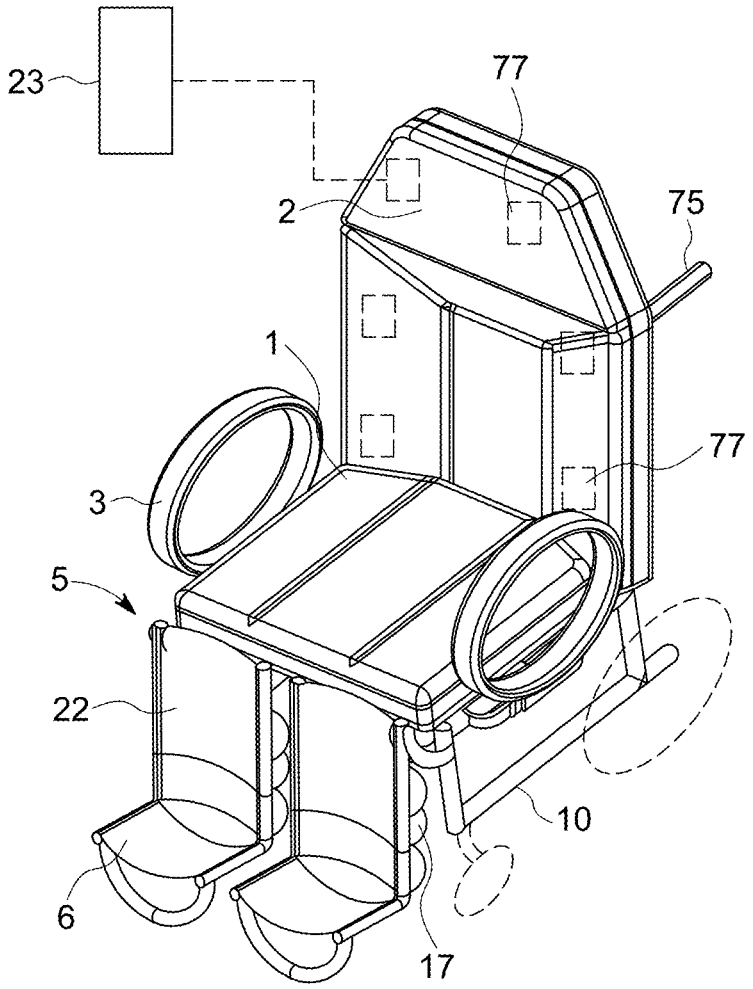
FIG. 1 is a perspective view of the wheelchair according to the present invention.

The present invention relates to a wheelchair comprising a chair member having a horizontal seat portion 1, a vertical backrest portion 2, a pair of opposing armrests 3 and a pair of leg braces 5. Preferably, the armrests 3 are ovate to aesthetically enhance the chair member relative to conventional mundane wheelchair configurations. Each leg brace is formed of a vertical calf rest 22 with a horizontal footrest 6 at a distal end. Semicircular tubes 17 on a rear surface of the vertical calf rest 22 structurally enhance the leg brace. The chair member and leg braces are mounted on an internal support frame 10 having a pair of manually operable rear wheels and front casters or wheels similar to those of a conventional wheelchair.

Figure 4:
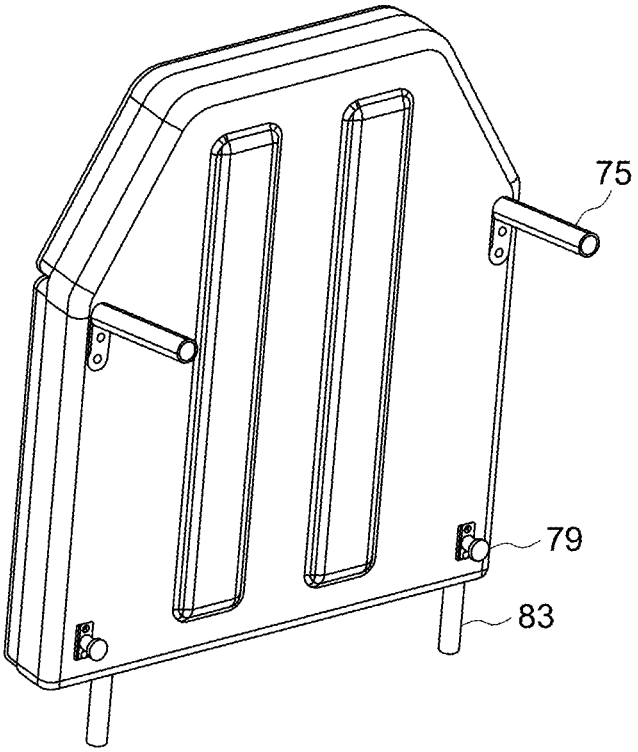
FIG. 4 is an isolated perspective view of the backrest.
Figure 5:
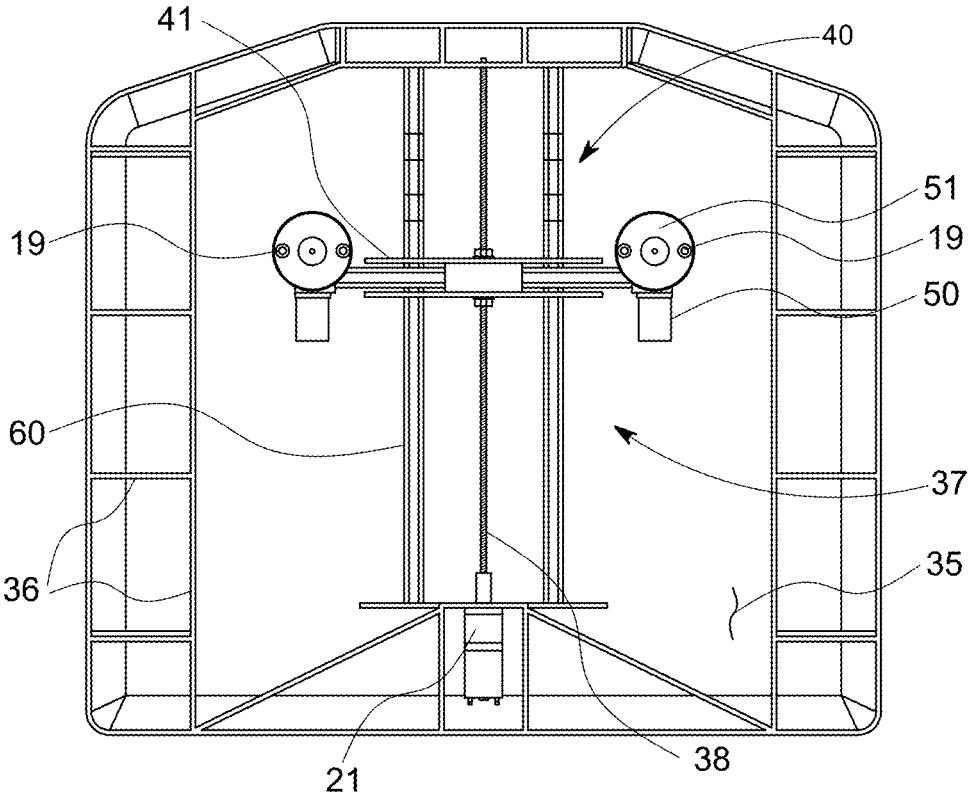
FIG. 5 is a top view of the seat with the cover plate and seat cushion removed to expose the second massaging unit.

Now referring to FIGS. 1 and 4, the backrest includes a pair of handles 75 on the rear surface that allow a caregiver to easily push the wheelchair along an underlying surface. Below the handles 75 are a pair of spring-biased buttons 79 that retract locking pins on a pair of inserts 83 depending from the lower edge of the backrest. The inserts releasably fit within hollow posts 88 on the support frame to allow the backrest to easily separate from the remainder of the wheelchair to facilitate transport or storage.

The improved wheelchair according to the present invention further includes a first massaging unit integral with the backrest for kneading the user's head, neck, shoulders and back. The first massaging unit preferably includes a plurality of motorized vibrating members 77 each positioned about the periphery of the backrest that can be activated simultaneously, sequentially, individually or in a random pattern.

Figure 2:
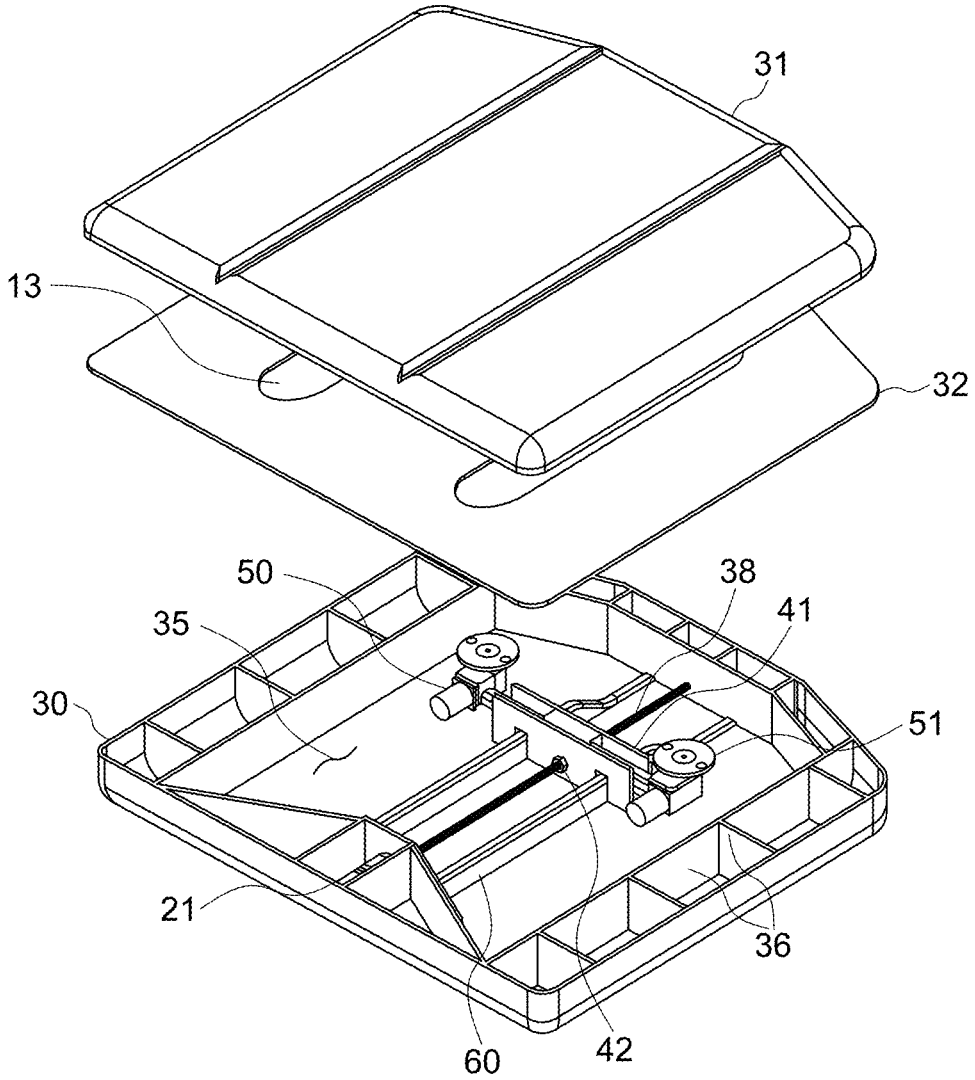
FIG. 2 is an exploded, perspective view of the seat depicting the second massaging unit.
Figure 3:
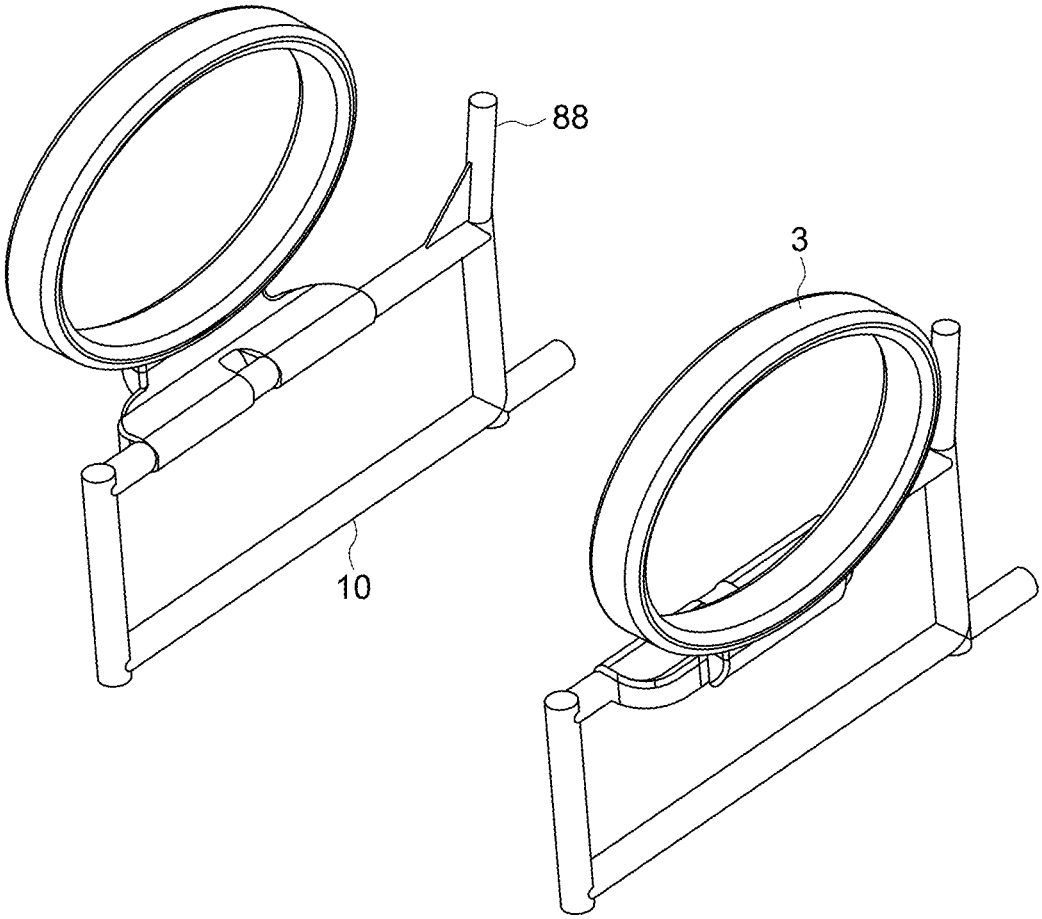
FIG. 3 is an isolated view of the armrests.

Now referring to FIG. 2, the seat portion is formed of a substantially hollow base component 30, a seat cushion 31 and an intermediate cover plate 32 positioned therebetween. The hollow base component 30 includes an interior chamber 35 surrounded by various reinforcement gussets 36 to absorb the weight of a person resting on the seat portion. Received within the interior chamber is a second massaging unit 37 for kneading the user's buttocks and thighs. The second massaging unit 37 includes an elongated drive screw 38 extending from a position proximal the rear edge of the interior chamber to a position proximal the front edge. The drive screw 38 is rotated by a primary drive motor 21 that reciprocates an impact member 40 between the front and rear ends of the seat portion. The impact member 40 includes a bracket 41 having a central threaded bore 42 that receives the drive screw whereby rotation of the primary motor axially translates the impact member along the drive screw in a given linear direction.

Spaced from and parallel to the drive screw are a pair of guide rails 60 that are each received within one of a pair of slots 61 on the bracket 41. The guide rails 60 prevent the impact member from contorting, twisting or shifting as it moves back and forth along the drive screw.

Mounted on each end of the bracket 41 is an auxiliary motor 50 that rotates a designated massaging disc 51 in either of two directions. In the preferred embodiment, the motors rotate each disc in opposite directions to create a unique therapeutic experience. The cover plate includes a pair of elongated slots 13 that allow the discs to engage the lower surface of the seat cushion while protecting the other internal components of the second massaging unit. On the upper surface of each disc are a pair of diametrically opposed protrusions 19 that impinge and penetrate the user's skin while the disc rotates to simulate a deeper-tissue massage.

When the second massaging unit is activated, the drive motor continuously moves the impact member forward and backwards while the auxiliary motors simultaneously rotate the discs in opposite directions. Therefore, the user experiences a unique, rolling thigh massage that continuously moves from the buttocks toward the knee and back to the buttocks.

A handheld remote unit 23 controls operation of both the seat and backrest massaging units using conventional electronics. The remote unit includes a microcontroller that regulates the mechanical devices as described above according to user input. Furthermore, the remote unit allows a user to selectively activate either of the first or second massaging units, or both as desired. The remote unit can be either wirelessly or physically connected to the appropriate electronics.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A wheelchair comprising:

a chair member having a horizontal seat portion and a vertical backrest portion, said seat portion having a rear edge and a front edge, said chair member mounted on a support frame having a plurality of wheels that allow the support frame to roll on an underlying surface;

a first massaging unit integral with said backrest portion for kneading a user's back, neck and shoulders;

a second massaging unit integral with said seat portion for kneading a user's buttocks and thighs;

means for moving said second massaging unit between the front edge of said seat portion and the rear edge of said seat portion to provide a rolling massage to the user's buttocks and thighs;

a pair of leg braces, each of said leg braces formed of a vertical calf rest with a horizontal footrest at a distal end;

semicircular tubes on a rear surface of the vertical calf rest to structurally enhance the leg brace.

2. The wheelchair according to claim 1 wherein the first massaging unit comprises a plurality of vibrating motorized members each peripherally positioned about the backrest that can be activated simultaneously, sequentially, individually or in a random pattern.

3. The wheelchair according to claim 1 wherein said second massaging unit includes at least one motorized rotating disc.

4. The wheelchair according to claim 1 wherein said means for moving said second massaging unit between the front edge of said seat portion and the rear edge of said seat portion comprises:

an elongated drive screw;

a primary drive motor operably connected to said drive screw for rotating said drive screw in each of two opposite directions;

said second massaging unit further including a bracket having a threaded bore that receives said drive screw whereby activation of the primary motor rotates said drive screw to axially translate the bracket along said drive screw.

5. The wheelchair according to claim 4 wherein said second massaging unit further comprises:

a motorized rotating disc at each end of said bracket.

6. The wheelchair according to claim 5 wherein said motorized rotating disc includes a pair of diametrically opposed protrusions that impinge and penetrate a user's skin while the disc rotates to simulate a deeper-tissue massage.

7. A wheelchair comprising:

a chair member having a horizontal seat portion and a vertical backrest portion, said seat portion having a rear edge and a front edge, said chair member mounted on a support frame having a plurality of wheels that allow the support frame to roll on an underlying surface;

a first massaging unit integral with said backrest portion for kneading a user's back, neck and shoulders;

a second massaging unit integral with said seat portion for kneading a user's buttocks and thighs;

means for moving said second massaging unit between the front edge of said seat portion and the rear edge of said seat portion to provide a rolling massage to the user's buttocks and thighs;

a pair of handles on the rear surface of said backrest;

a pair of spring-biased buttons adjacent said handles that retract locking pins on a pair of inserts depending from a lower edge of the backrest, said inserts releasably fitting within hollow posts on the support frame to allow the backrest to easily separate from the remainder of the wheelchair to facilitate transport or storage.

8. The wheelchair according to claim 7 wherein said chair member further comprises a pair of opposing armrests.

9. The wheelchair according to claim 8 wherein said armrests are ovate to aesthetically enhance the chair member.

10. The wheelchair according to claim 7 wherein said seat portion is formed of a hollow base component with a seat cushion superimposed thereon.

11. The wheelchair according to claim 10 further comprising:

a cover plate positioned between said base component and said seat cushion for protecting said second massaging unit.

12. The wheelchair according to claim 11 wherein said cover plate includes an elongated slot that accommodates said motorized rotating disc to allow said disc to engage a lower surface of said seat cushion.

13. The wheelchair according to claim 7 wherein said chair member further comprises a pair of leg braces, each of said leg braces formed of a vertical calf rest with a horizontal footrest at a distal end.

14. The wheelchair according to claim 13 further comprising semicircular tubes on a rear surface of the vertical calf rest to structurally enhance the leg brace.

* * * * *